US006523738B1

(12) United States Patent
Sarne et al.

(10) Patent No.: US 6,523,738 B1
(45) Date of Patent: Feb. 25, 2003

(54) PACKAGING FOR A BOTTLE

(75) Inventors: Giorgio Sarne, Reims (FR); Benoit Simottel, Brest (FR)

(73) Assignee: Veuve Clicquot Ponsardin Maison Fondee en 1772, Reims (FR)

( * ) Notice: Subject to any disclaimer, the term of this patent is extended or adjusted under 35 U.S.C. 154(b) by 0 days.

(21) Appl. No.: 09/857,039

(22) PCT Filed: Dec. 3, 1999

(86) PCT No.: PCT/FR99/03004

§ 371 (c)(1),
(2), (4) Date: Aug. 13, 2001

(87) PCT Pub. No.: WO00/34134

PCT Pub. Date: Jun. 15, 2000

(30) Foreign Application Priority Data

Dec. 4, 1998 (FR) ..... 98 15361

(51) Int. Cl.[7] ..... B65D 5/355

(52) U.S. Cl. ..... 229/101; 229/89; 229/123; 229/186

(58) Field of Search ..... 229/89, 101, 123, 229/186; 62/457.1, 457.8; 383/2, 4, 120

(56) References Cited

U.S. PATENT DOCUMENTS

| | | | | |
|---|---|---|---|---|
| 3,006,165 A | | 10/1961 | Mittelberger | |
| 3,150,812 A | * | 9/1964 | Sabol | 229/101 |
| 3,495,762 A | * | 2/1970 | Verbic | 383/2 |
| 3,929,274 A | * | 12/1975 | Akkerman | 229/123 |
| 5,094,359 A | | 3/1992 | DeMars et al. | |
| 5,307,986 A | * | 5/1994 | Schuster | 229/186 |
| 5,454,644 A | * | 10/1995 | Augustin | 383/120 |
| 5,706,947 A | * | 1/1998 | Hodges | 229/101 |
| 5,975,411 A | * | 11/1999 | Windolph, III | 229/101 |

FOREIGN PATENT DOCUMENTS

| | | |
|---|---|---|
| DE | 1 205 005 X | 11/1965 |
| DE | 9 010 792.6 A | 10/1990 |
| FR | 2 758 530 A | 7/1998 |
| GB | 2 236 739 A | 4/1991 |

* cited by examiner

*Primary Examiner*—Gary E. Elkins
(74) *Attorney, Agent, or Firm*—Leydig, Voit & Mayer, Ltd.

(57) ABSTRACT

The invention concerns a package for a bottle including an envelope having parts which are alternatively planar and accordion-folded, and capable of being unfolded to receive a liquid for refrigerating the bottle. Each accordion-folded part is folded on each side of a planar folding line, extending in zigzag from the base of the envelope to a free edge.

19 Claims, 3 Drawing Sheets

1
B
6
6a
6a
7
7
8
9
9
11
11
12
12
14
14
15
15
16
16
21
22
23
24
25
26
26a
29
30
31
31
5

1
2
5
6
6
6
7
7
7
8
8
8
9
9
9
9
15
15
15
16
16
16
B

PACKAGING FOR A BOTTLE

FIELD OF THE INVENTION

In general, the present invention concerns packaging made of cardboard or the like and, in particular, packaging for a bottle.

More precisely, the invention concerns packaging for a bottle, comprising an envelope formed from an impermeable and approximately planar cardboard blank, which is folded in such a way as to have a bottom and an enveloping wall including planar parts that alternate with accordion-folded parts, each accordion-folded part being connected to first and second adjacent planar parts by first and second respective shared edges which meet at the bottom of the envelope in order to form a principal V-shaped fold, wherein the package may be unfolded to constitute a container suitable for holding a liquid for refrigerating the bottle in the container.

BACKGROUND

A packaging of this type is known, for example, from U.S. Pat. No. 5,094,359 and German Patent No. 1 205 005.

As is shown in particular by the latter document, such packaging can be used, specifically in its folded configuration, to protect its relatively fragile contents, such as a champagne bottle, from impact, and in its unfolded configuration, to fulfill the function of a champagne bucket.

An essential difficulty which must be overcome by the realization and use of such packaging lies in the absolute necessity of making this packaging water-tight in its unfolded configuration in spite of the possible deformations and surface wear which it may undergo from the time of manufacture to the time of final use.

SUMMARY OF THE INVENTION

In this context, the task of the invention is precisely to propose packaging which is specifically designed in response to this necessity.

For this purpose, in the packaging of the invention, in other respects in accordance with the definition given above, each accordion-folded part is folded on both sides of a planar folding line extending in zigzag form from the bottom of the envelope to a free edge of the envelope.

The main advantage thus offered by the arrangement of the invention is that the vertices formed by the folding lines are distributed along the folding line in a zigzag instead of being concentrated in the same region as disclosed, for example, by German Patent No. 1 205 005, since such a concentration promotes a significant increase in the fragility of the envelope in the region of concentration of the vertices.

In the preferred embodiment of the packaging of the invention, in addition to some first and second shared edges that define the principal V-shaped fold, each accordion-like part has internal folding lines that define at least two additional V-shaped folds, with the planar folding line passing through respective vertices of the principal V-shaped fold and of the additional V-shaped folds, and the additional V-shaped folds are imbricated one over the other and homothetic with respect to the principal V-shaped fold by translation along the planar folding line.

Thus, a second advantage of the invention, associated with the first, is that with the exception of the vertex corresponding to the principal V-shaped fold, the vertices formed by the folding lines are separated from the corners of the envelope, that is, from the regions of the envelope subject to the greatest risk of rupturing impact and/or wear.

Preferably, the planar parts form strips of equal length, with parallel edges, connected together by the bottom of the envelope, which is, for example, a convex polygon, wherein the planar parts delineate a star when the envelope is lying flat, with the number of arms equal to the order of the polygon.

In the simplest embodiment of the invention, the bottom, which can be a regular polygon, is advantageously at least a polygon of relatively low order, for example, a square or a rectangle, that is, a rectangular polygon of order four, where the star then assumes the form of a cross with four arms.

The packaging can furthermore have a reinforcement attached to the envelope, for example, by gluing, and covering at least partially the bottom and the planar parts of this envelope.

In order positively to hold the envelope in the unfolded position of the container, holding components are advantageously provided, these holding components comprising, for example, pairs of flaps that can be unfolded from the reinforcement, a first flap of each pair having a slit, and a second flap of this pair having a tab which is selectively inserted and retained in the slit.

In order better to withstand transport and present a nice appearance, the packaging of the invention can furthermore have a case in which the envelope is selectively inserted and held in folded position in order to protect the bottle.

Finally, the envelope is preferably covered, on its inner surface at least, with a water-resistant material such as a PET-plus-aluminum complex.

BRIEF DESCRIPTION OF THE DRAWINGS

Other advantages and characteristics of the invention will appear more clearly in the following detailed description in reference to the appended drawings given only as an example and in which.

Figure 1:
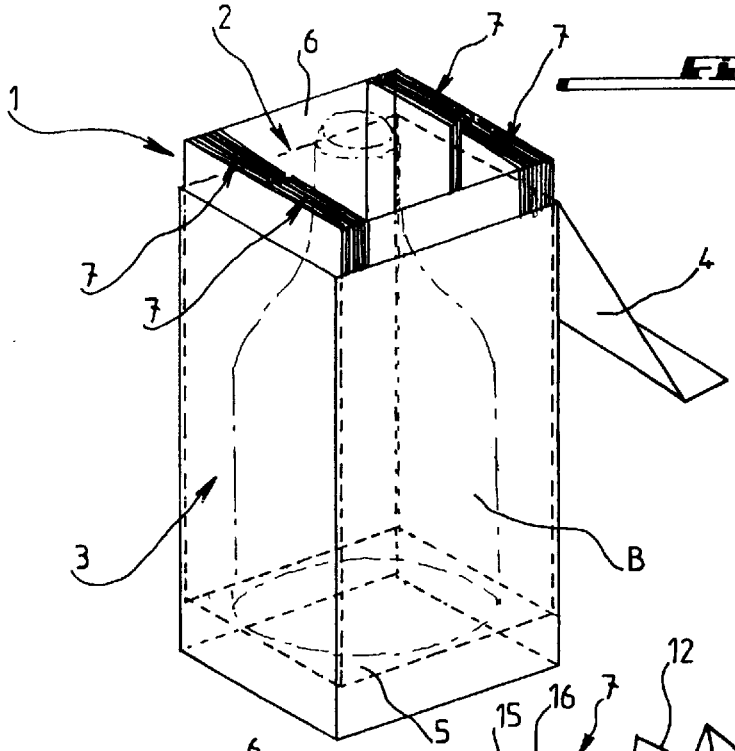
FIG. 1 is a perspective view of packaging according to the present invention, where the packaging comprises an envelope inserted in a case and shown in a position slightly withdrawn from the case.
Figure 2:
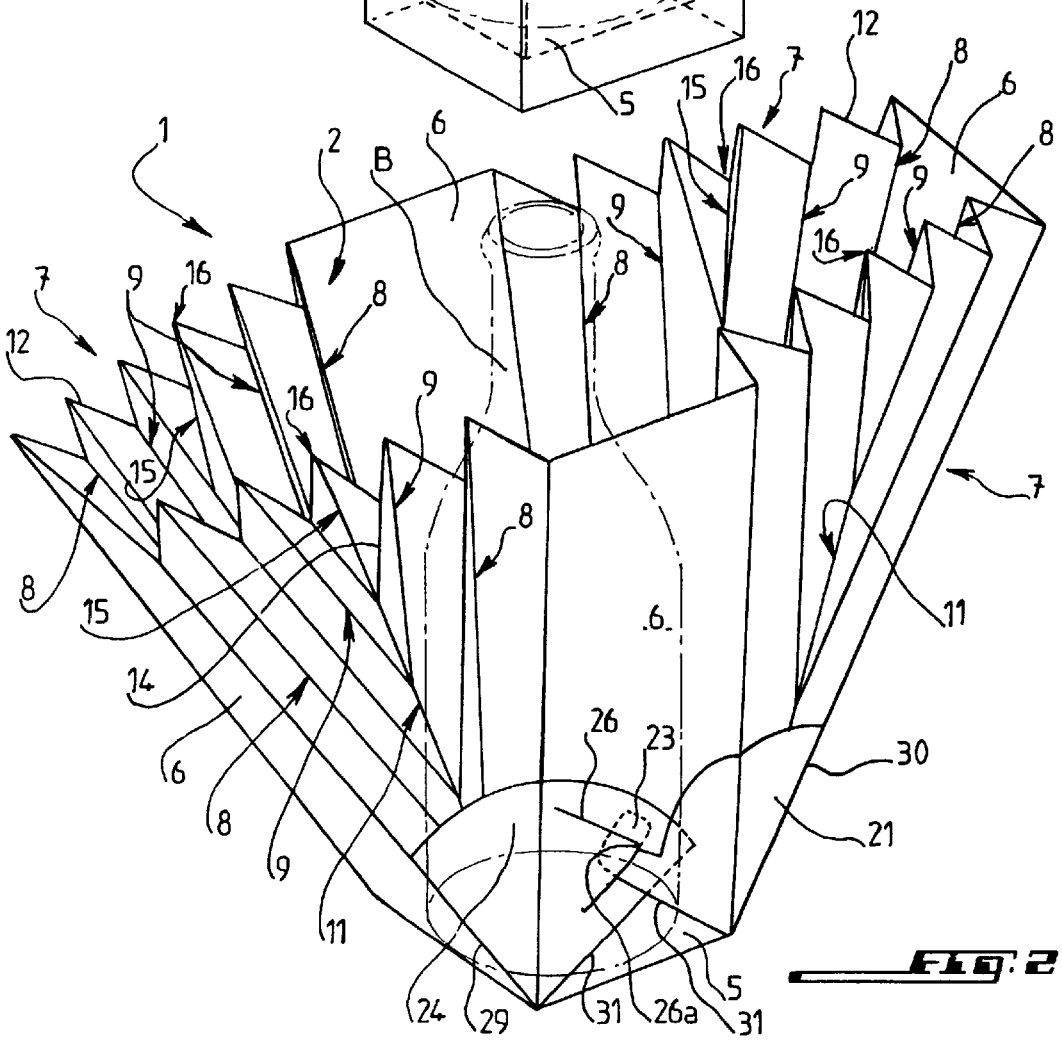
FIG. 2 is a perspective view of the envelope in the open position, which, in this position, forms a container or a sealed vessel, which is capable of containing a bottle in order to refrigerate it.
Figure 3:
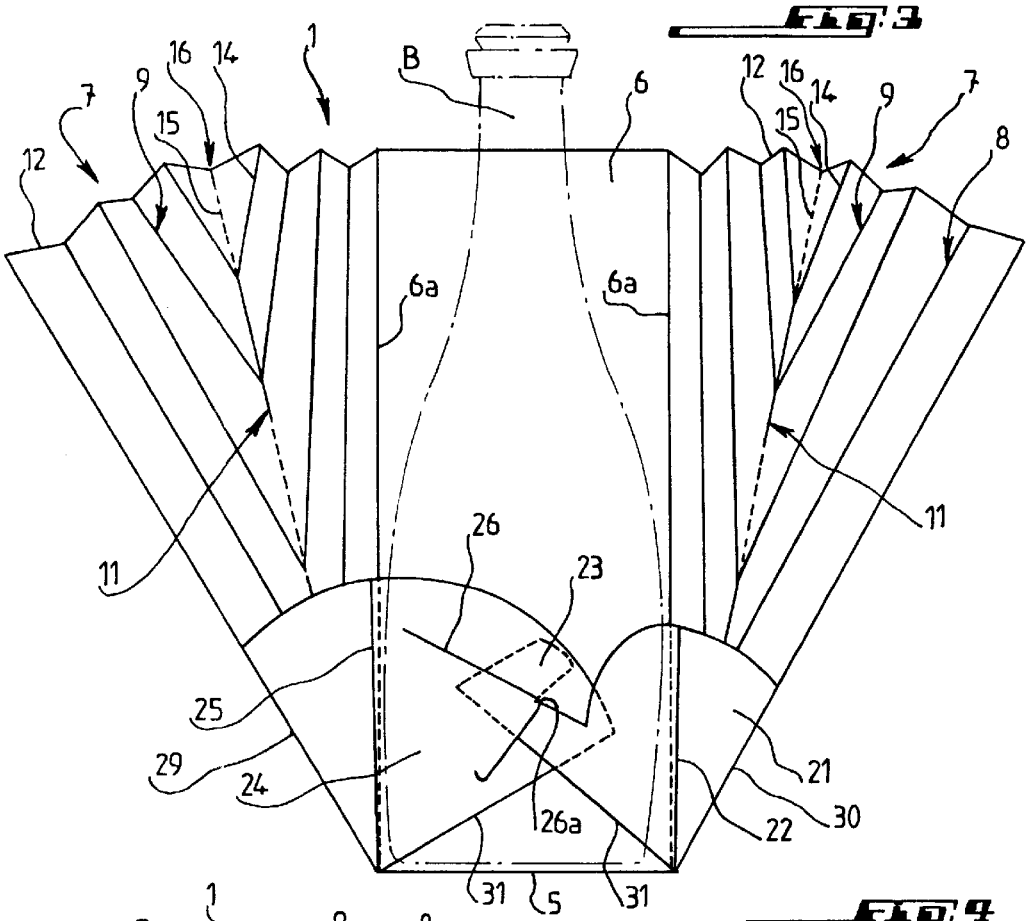
FIG. 3 is a lateral elevation of the envelope in the open position.
Figure 4:
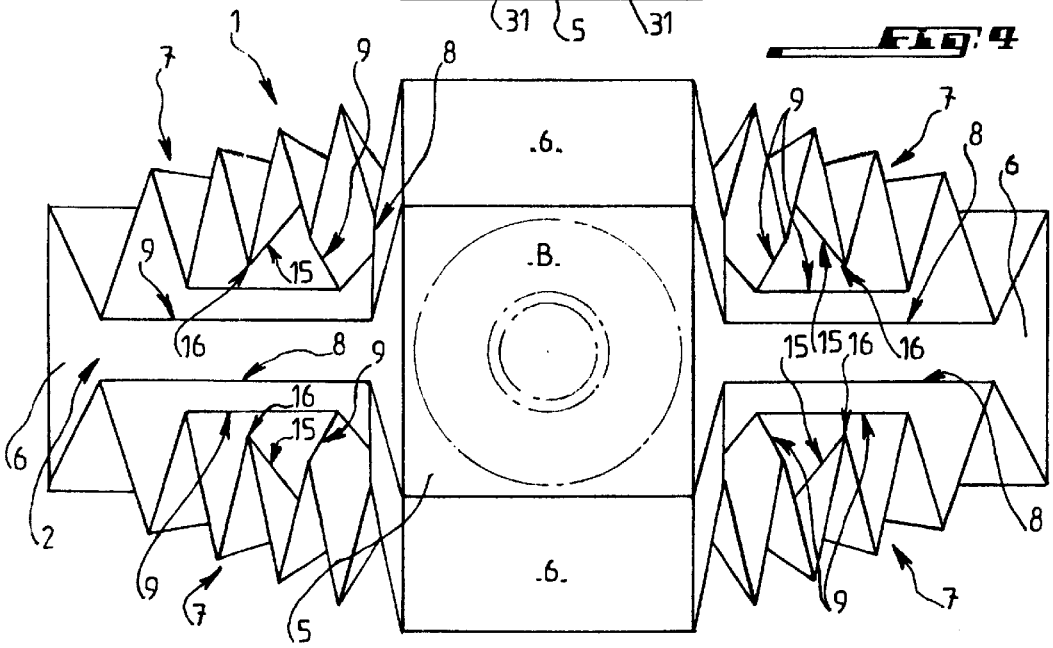
FIG. 4 is a top view of the open envelope in the form of a container.

As shown clearly in FIGS. 1 to 4, the packaging according to the present invention has envelope 1 made of cardboard or a similar material. This envelope generally includes a number of folded walls, which, in the folded position, as shown in FIG. 1, form a container capable of holding a bottle B, and, in the unfolded position, as shown in FIGS. 2 to 4, form a container capable of holding a liquid for refrigerating the bottle B. In this regard, envelope 1 will have, preferably on inner surface 2, an impermeable covering, such as a metallized polymer film, for example, a PET-plus-aluminum complex.

Returning to FIG. 1, one sees that in the folded position, envelope 1 can be inserted into case 3, which can be a conventional cardboard box with cover 4.

Envelope 1, as seen clearly in FIGS. 1 to 5, includes bottom 5 and an enveloping lateral wall having planar parts 6 separated and connected by accordion-folded parts 7.

According to the example represented, there are four rectangular planar parts 6 which form a part of the vertical wall of the envelope. When the envelope is lying flat, as shown in FIG. 5, these planar parts 6 form a cross with four arms of equal length and of equal width and that intersect to form a square bottom 5 of the envelope, which receives the bottom of bottle B.

As can be seen clearly in FIGS. 2 to 5, there are also four vertical accordion-folded parts 7, each of which is square in the flattened position (FIG. 5) and has a certain number of folding lines.

For each accordion-folded part 7, these folding lines define two imbricated homothetic V's 8, 9 projecting towards the interior of envelope 1, whose points 10, when the envelope is lying flat, are directed towards the center of bottom 5 of this envelope. These folding lines also define fold 15, which also projects towards the interior of the packaging and ends at free edge 12 of the packaging.

Figure 5:
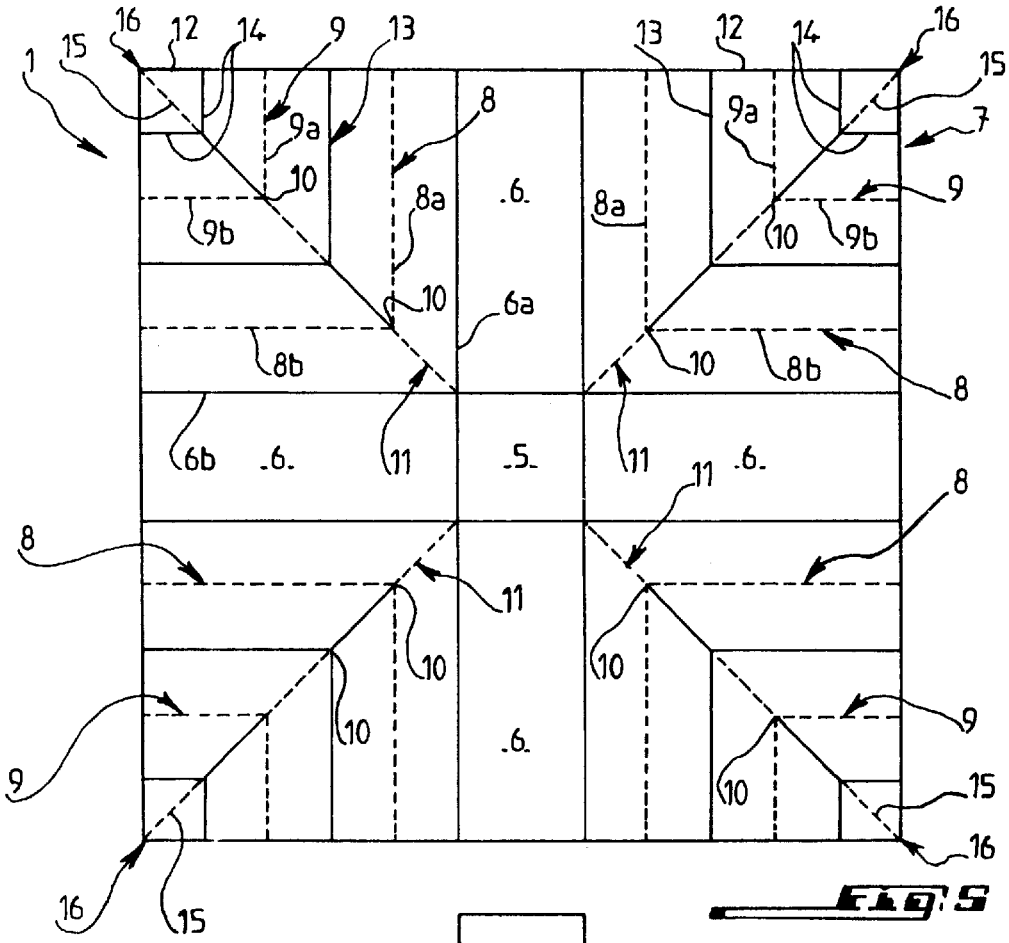
FIG. 5 is a bottom plan view of the envelope in the flattened position.

FIG. 5 clearly shows that one branch 8*a*, 9*a* of the two V's 8, 9 is parallel to edge 6*a* of one of planar parts 6 while being connected to the planar part, while the other branch 8*b*, 9*b* of the two imbricated V's 8, 9 is parallel to edge 6*b* of a neighboring planar part while being connected to the planar part. As is evident from FIG. 5, each of the two imbricated V's 8, 9 that can be seen in FIGS. 2 to 4 forms a right angle with point 10 when envelope 1 is lying flat, forming a square bottom. In the figure, represented in the form of dotted lines are the folding lines projecting on the interior side of the envelope, and represented in the form of solid lines are the folding lines recessed on the interior side of the envelope which forms a container as explained above.

As can be understood with the aid of FIG. 5, each accordion-folded part 7 also has zigzag folding line 11 located in the plane passing through point 10 of the two imbricated V's 8, 9. This zigzag or broken folding line 11 ends, on the one hand, at the intersection of two neighboring planar parts 6, and on the other hand, at vertex 16 of each folding part 7, passing through fold 15, where vertex 16 is on the free edge 12 of envelope 1. More precisely, the alternating dotted and solid lines forming folding line 11 in FIG. 5 show that the line consists of a series of alternating recessed and projecting broken lines.

It will also be observed that all the folding lines of each accordion-folded part 7 between one another define walls of approximately equal width. Thus, the wall between folding line 8*a* and edge 6*a* of planar part 6 has a width approximately equal to that of the wall between folding line 8*a* and the intermediate folding line 13 between the line 8*a* and folding line 9*a*, to that of the wall between folding line 13 and folding line 9*a*, and to that between folding line 9 and the last folding line 14 at the corner of each angle of the cardboard blank constituting the envelope. Furthermore, folds 14 define a square with free edge 12 in each exterior angle of the envelope lying flat. It is therefore understood that successive folding lines 14, 9, 13, and 8 form V's with branches parallel to one another and to edge 6*a* of the planar parts 6, It is understood, as explained in the preceding description, that folding line 11 consists of alternating recessed and projecting broken lines with reversal of the direction of these broken lines at the intersection of folding line 11 with the point of all the V's.

In short, as seen in FIGS. 2, 3 and 4, each accordion-folded part 7 connected to two neighboring planar parts 6 is formed by a number of alternatingly projecting and re-entrant dihedra which converge towards the center of bottom 5 of packaging 1 on both sides of the plane containing zigzag folding line 11, which, when packaging 1 is in the flattened position, as seen in FIG. 5, passes through the center of the square wall forming bottom 5 of the packaging.

Figure 6:
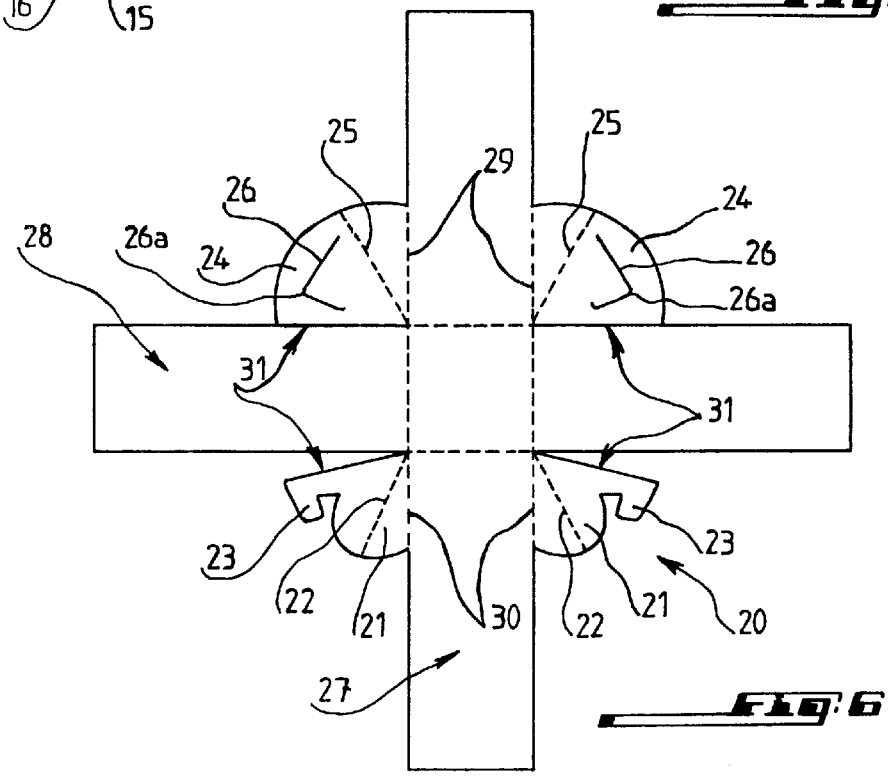
FIG. 6 is a plan view, also in the flattened position, of a reinforcement which is to be attached to the bottom of the envelope, which can be seen in FIG. 5.

FIG. 6 shows a reinforcement 20 for the envelope in the form of a cross identical to the cross formed by the four walls 6 in FIG. 5. This reinforcement, made of cardboard, for example, can be attached by gluing to the exterior surface of the envelope in an exactly superimposed position on planar walls 6 and bottom 5.

It can also be seen in FIG. 6 that cruciform reinforcement 20 has, on one side, two opposing flaps 21, each with folding line 22 and a hook-shaped part 23 at the end. On the other side, and opposite the flaps 21, are another pair of flaps 24, each with folding lines 25 and a slit 26 in which hook-shaped part 23 can be inserted. More precisely, reinforcement 20 includes two arms 27, 28 at a right angle, with flaps 21 and 24 situated on both sides of arm 28. 29 and 30 respectively indicate lines for folding flaps 24, 21 with respect to arm 27 of reinforcement 20. Also, 31 indicates the cut free edges of flaps 21, 24.

Thus, as is shown clearly in FIGS. 2 and 3, flaps 21 and 24 of reinforcement 20 are folded against planar walls 6 of envelope 1, or, more precisely, respectively against the two halves of arm 28 of reinforcement 20 which are superimposed on the planar walls 6. Thus, hook-shaped parts 23 can be introduced into their respective slits 26 where they can slide. Therefore, when envelope 1 is withdrawn from its case 3, as can be seen with reference to FIG. 1, this envelope spreads out, flaring at the upper part to form the container shown in FIGS. 2 and 3, where it is understood that with this spreading, hook-shaped parts 23 will slide in slits 26 until the hook-shaped parts 23 stop at end 26*a* of slits 26, that is, at a point where each of slits 26 forms an elbow, which can be seen clearly in FIGS. 2, 3 and 6. Thus, envelope 1 will be locked for a given open position appropriate for forming a container for holding a liquid that can refrigerate the contents of bottle B housed in the container.

Packaging for a bottle is therefore produced according to the invention, which can be transformed almost instantly into a container or vessel for presentation and refrigeration of said bottle.

Of course, the invention is in no way limited to the embodiment described and illustrated, which was given only as an example, but rather extends to all packaging that satisfies the definition given for it in the claims.

What is claimed is:

1. A packaging for a bottle including an envelope made from an approximately planar blank, folded to have bottom and an enveloping wall including planar parts alternating with accordion-folded parts, each accordion-folded part being connected to first and second adjacent planar-parts by first and second respective shared edges which meet at the bottom, defining a principal V-shaped fold wherein the envelope may be spread out to form a container retaining a liquid for refrigerating a bottle in the container, wherein each accordion-folded part is folded on opposite sides of a folding line extending, in a zigzag shape, from the bottom of the envelope to a free edge of the envelope.

2. The packaging according to claim 1, wherein the planar parts are strips of equal length, with parallel edges, connected together by the bottom.

3. The packaging according to claim 2, wherein the bottom is a convex polygon having an order, and the planar parts, when the envelope is lying flat, delineate a star with a number of arms equal to the order of the polygon.

4. The packaging according to claim 3, wherein the bottom is a regular polygon.

5. The packaging according to claim 3, wherein the bottom is a fourth order polygon and the star is a cross with four arms.

6. The packaging according to claim 1, including a reinforcement attached to the envelope and covering, at least partially, the bottom and the planar parts of the envelope.

7. The packaging according to claim 6, including holding components positively holding the envelope in an unfolded position of the container.

8. The packaging according to claim 6, wherein the holding components include pairs of flaps that can be unfolded from the reinforcement, a first flap of each pair of flaps having a slit, and a second flap of each pair of flaps having a tab that is selectively insertable in the slit.

9. The packaging according to claim 6, including a case into which the envelope is inserted and held in the folded position to protect a bottle.

10. The packaging according to claim 1, including a case into which the envelope is inserted and held in the folded position to protect a bottle.

11. The packaging according to claim 1, wherein the envelope has an inner surface covered with a water-resistant material.

12. The packaging according to claim 1, including holding components positively holding the envelope in an unfolded position of the container.

13. The packaging according to claim 1, wherein the water-resistant material includes PET and aluminum.

14. The packaging according to claim 1, wherein, in addition to the first and second shared edges which define a principal V-shaped fold, each accordion-like part has internal folding lines which define at least two additional V-shaped folds, the folding line passes through respective vertices of the principal V-shaped fold and of two additional V-shaped folds, and the two additional V-shaped folds are imbricated, one over the other, and are homothetic with respect to the principal V-shaped fold by translation along the folding line.

15. The packaging according to claim 14, wherein the planar parts are strips of equal length, with parallel edges, connected together by the bottom.

16. The packaging according to claim 15, wherein the bottom is a convex polygon having an order, and the planar parts, when the envelope is lying flat, delineate a star with a number of arms equal to the order of the polygon.

17. The packaging according to claim 14, including a reinforcement attached to the envelope and covering, at least partially, the bottom and the planar parts of the envelope.

18. The packaging according to claim 14, including a case into which the envelope is inserted and held in the folded position to protect a bottle.

19. The packaging according to claim 14, wherein the envelope has an inner surface covered with a water-resistant material.

* * * * *